US011325684B2

(12) United States Patent
Bai et al.

(10) Patent No.: US 11,325,684 B2
(45) Date of Patent: May 10, 2022

(54) INFLATABLE KAYAK

(71) Applicant: JIANGSU JILONG SPORT AND LEISURE PRODUCTS CO., LTD., Suqian (CN)

(72) Inventors: Hao Bai, Suqian (CN); Wei Shen, Suqian (CN); Shanshan Tang, Suqian (CN)

(73) Assignee: JIANGSU JILONG SPORT AND LEISURE PRODUCTS CO., LTD., Suqian (CN)

( * ) Notice: Subject to any disclaimer, the term of this patent is extended or adjusted under 35 U.S.C. 154(b) by 0 days.

(21) Appl. No.: 17/037,957

(22) Filed: Sep. 30, 2020

(65) Prior Publication Data

US 2021/0387700 A1 Dec. 16, 2021

(30) Foreign Application Priority Data

Jun. 10, 2020 (CN) ..... 202010522309.2

(51) Int. Cl.
*B63B 34/22* (2020.01)
*B63B 7/08* (2020.01)

(52) U.S. Cl.
CPC ..... *B63B 34/22* (2020.02); *B63B 7/085* (2013.01)

(58) Field of Classification Search
CPC ..... B63B 34/22; B63B 7/085
See application file for complete search history.

(56) References Cited

U.S. PATENT DOCUMENTS

| | | | | |
|---|---|---|---|---|
| 7,021,233 | B2 * | 4/2006 | Hall | B63B 34/22 114/347 |
| 9,452,809 | B2 * | 9/2016 | Hoge, Jr. | B63B 34/22 |
| 9,637,201 | B2 * | 5/2017 | Hoge, Jr. | B63B 34/22 |
| 9,694,875 | B2 * | 7/2017 | Excoffon | B63B 15/02 |
| 10,583,895 | B2 * | 3/2020 | Haller | B63B 7/082 |
| 2003/0010271 | A1 * | 1/2003 | Coates | B63B 43/14 114/123 |
| 2005/0022715 | A1 * | 2/2005 | Dunn | B63H 16/02 114/345 |
| 2006/0032425 | A1 * | 2/2006 | Hall | B63B 34/23 114/347 |
| 2009/0031941 | A1 * | 2/2009 | Czarnowski | B63B 34/23 114/345 |
| 2009/0078186 | A1 * | 3/2009 | Rista | B63B 34/22 114/345 |

(Continued)

*Primary Examiner* — S. Joseph Morano
*Assistant Examiner* — Jovon E Hayes

(57) ABSTRACT

The present disclosure provides an inflatable kayak. The inflatable kayak includes an inflatable floor having two ends defined upward; two inflatable gunwales arranged on the left and right sides of the inflatable floor, the height of the upper edge at both ends of the inflatable gunwale being higher than the height at the middle of the inflatable gunwale, allowing the height of the prow and the stern of the inflatable kayak to be no less than the height at the middle of the inflatable kayak; and a reinforcing assembly including a bottom reinforcing layer, a prow hatchway cover, and a stern hatchway cover, the bottom reinforcing layer at least covering the joints of the inflatable floor and the two inflatable gunwales. The prow hatchway cover connects the two inflatable gunwales at the prow, and the stern hatchway cover connects the two inflatable gunwales at the stern.

9 Claims, 5 Drawing Sheets

(56) References Cited

U.S. PATENT DOCUMENTS

| | | | | |
|---|---|---|---|---|
| 2009/0078187 | A1* | 3/2009 | Rodger | B63H 20/02 114/355 |
| 2012/0024218 | A1* | 2/2012 | Haller | B63B 34/22 114/345 |
| 2014/0202370 | A1* | 7/2014 | Smith | B63B 43/14 114/345 |
| 2015/0059635 | A1* | 3/2015 | Fritsch | B63B 5/24 114/345 |
| 2017/0273490 | A1* | 9/2017 | McMahan | A47G 27/0231 |
| 2021/0129957 | A1* | 5/2021 | Hugh | B63C 9/24 |

* cited by examiner

INFLATABLE KAYAK

FIELD OF THE PRESENT DISCLOSURE

The present disclosure relates to the field of inflatable kayaks, and more particularly to an inflatable kayak.

DESCRIPTION OF RELATED ART

Kayak leisure sports have been widely existed abroad with people's constant pursuit of healthy and quality life, and gradually began to arise in China. Inflatable kayaks are more and more popular because of the advantages of light weight, foldability after air escape, portability, and easy to store.

In related art, the inflatable kayak generally includes prow, hull, and stern connected successively. The bow and the stern are lower than the middle of the hull, which makes the inflatable kayak difficult to glide because of a large resistance, and provides the kayak an unaesthetic appearance. In addition, the inflatable kayaks are commonly made of a single layer of material, which is prone to be damaged and deflated because of frequently collisions, making them unusable.

Therefore, it is desirable to provide a new inflatable kayak to solve the above technical problems.

SUMMARY OF THE PRESENT DISCLOSURE

The present disclosure is to provide an inflatable kayak which has a low resistance during gliding, a high strength, and is not prone to be damaged.

For this purpose, the present disclosure provides an inflatable kayak including:

an inflatable floor having two ends defined upward, the inflatable floor being a drop stitch fabric floor;

two inflatable gunwales arranged on the left and right sides of the inflatable floor, each the bottom side of the inflatable gunwales being connected to one side of the inflatable floor, the height of the upper edge at both ends of the inflatable gunwale being higher than the height at the middle of the inflatable gunwale, allowing the height of the prow and the stern of the inflatable kayak to be no less than the height at the middle of the inflatable kayak; and a reinforcing assembly, the reinforcing assembly including a bottom reinforcing layer, a prow hatchway cover, and a stern hatchway cover; the bottom reinforcing layer at least covering the joints of the inflatable floor and the two inflatable gunwales, the bottom of the bottom reinforcing layer being connected with the inflatable floor, and the top of the bottom reinforcing layer being connected with the inflatable gunwales;

the prow hatchway cover connects the two inflatable gunwales at the prow, and the stern hatchway cover connects the two inflatable gunwales at the stern.

As a preferred technical solution for the inflatable kayak, the inflatable gunwale is cylindrical, the inflatable gunwale includes two side portions and two edge banding strips, the peripherals of the two side portions are connected by the two edge banding strips, and the outer side of the edge banding strip is covered by a first reinforcing strip;

the bottom reinforcing layer covers the bottom surface and two lateral surfaces of the inflatable floor, and the lateral sides of the bottom reinforcing layer connect the outer lateral sides of the inflatable gunwales.

As a preferred technical solution for the inflatable kayak, the two side portions are butted with each other;

the joint of the bottom reinforcing layer and the inflatable gunwale is covered by at least one first reinforcing strip.

As a preferred technical solution for the inflatable kayak, the height of the upper edge at both ends of the side portion is higher than the height at the middle of the side portion, allowing the height of the prow and the stern of the inflatable kayak to be no less than the height at the middle.

As a preferred technical solution of the inflatable kayak, the inflatable gunwale is plate shaped and includes a side plate made of drop stitch fabric and an edge banding sheet connected to a top surface of the side plate, and the edge banding sheet is covered by a reinforcing sheet;

the bottom reinforcing layer covers the peripheral of the bottom surface of the inflatable floor, a portion of lateral surface of the inflatable floor, and a portion of outside surface of the inflatable gunwale; one side of the bottom reinforcing layer is connected to the bottom surface of the inflatable floor and the other side of the bottom reinforcing layer is connected to the outside surface of the inflatable gunwale.

As a preferred technical solution of the inflatable kayak, the inflatable kayak further includes decorative strips, the joint of the reinforcing sheet and the side plate at the outer side is covered by the decorative strip; the joint of the prow hatchway cover and the inflatable gunwale and the joint of the stern hatchway cover and the inflatable gunwale are both covered by the decorative strip.

As a preferred technical solution for the inflatable kayak, the inflatable kayak further includes boat caps and second reinforcing strips, and the prow and the stern are respectively sleeved with a boat cap;

the second reinforcing strip is arranged at the edge of the boat cap, the boat cap at the prow is connected to the prow hatchway cover, the two inflatable gunwales, and the inflatable floor through the second reinforcing strip, and the boat cap at the stern is connected to the stern hatchway cover the two inflatable gunwales, and the inflatable floor through the second reinforcing strip.

As a preferred technical solution for the inflatable kayak, the inflatable kayak further includes at least one elastic rope, and the at least one elastic rope is connected between the two inflatable gunwales 2 at the prow.

As a preferred technical solution of the inflatable kayak, at least one side of the prow or at least one side of the stern is provided with a safety rope, two ends of the safety rope are fixed on the inflatable gunwale;

the safety rope is fixed to the inflatable gunwale by bonding or welding.

As a preferred technical solution of the inflatable kayak, the inflatable floor is defined with a drain hole, and a drain valve is arranged at the drain hole; water in the kayak is discharged through the drain hole and the drain valve.

The two ends of the inflatable floor are designed upward so that the height of the prow and the stern is higher than the height at the middle of the hull. As such, the resistance of the inflatable kayak in gliding is reduced, and the inflatable kayak looks more attractive. The bottom reinforcing layer covers the joint of the inflatable floor and the inflatable gunwale, which enhances the strength of the inflatable kayak, thus in case the inflatable kayak is collided, it is the bottom reinforcing layer that undergoes the impacts. Since the bottom reinforcing layer has a high strength, the bottom reinforcing layer is not prone to be damaged, ensuring the integrity of the inflatable kayak and increasing the service life of the inflatable kayak.

In addition, the prow hatchway cover and the stern hatchway cover connect the ends of the two gunwales together, which increase the strength of the prow and the stern.

Figure 1:
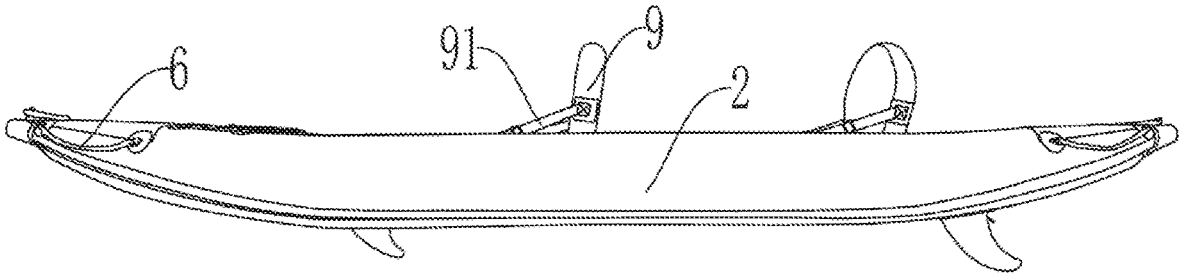
FIG. 1 is a first structure diagram of an inflatable kayak in accordance with a first embodiment of the present disclosure.
Figure 2:
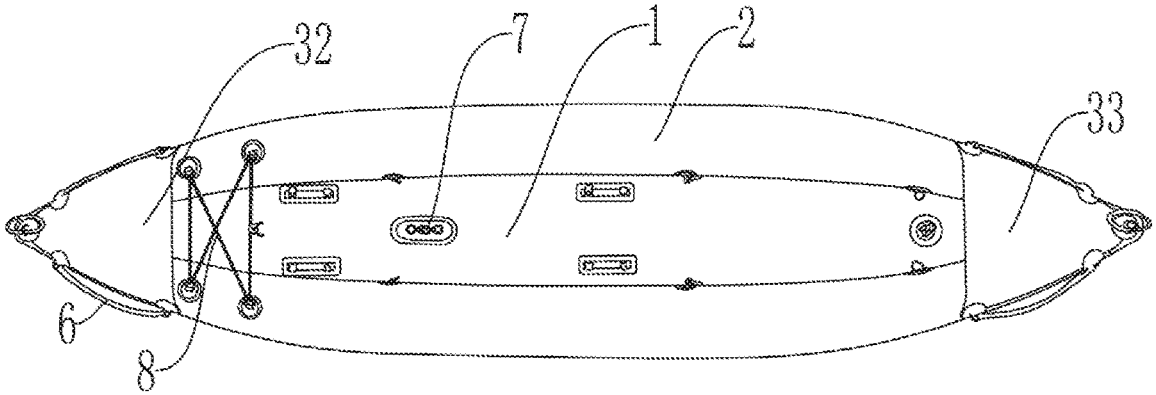
FIG. 2 is a second structure diagram of the inflatable kayak in accordance with the first embodiment of the present disclosure.
Figure 3:
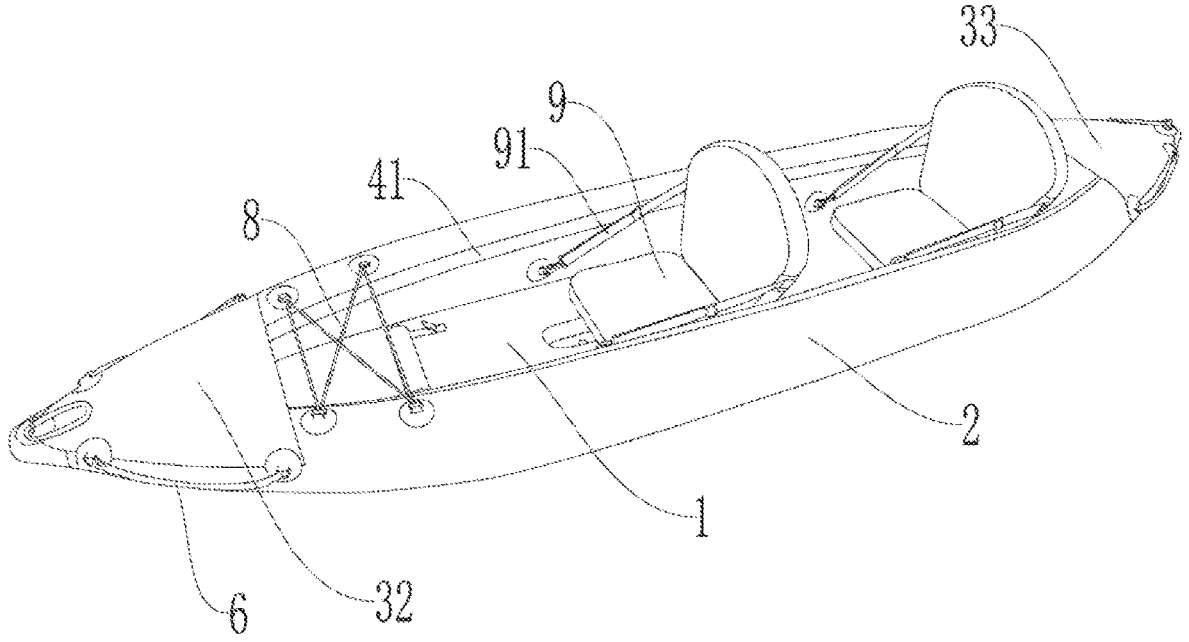
FIG. 3 is a third structure diagram of the inflatable kayak in accordance with the first embodiment of the present disclosure.
Figure 4:
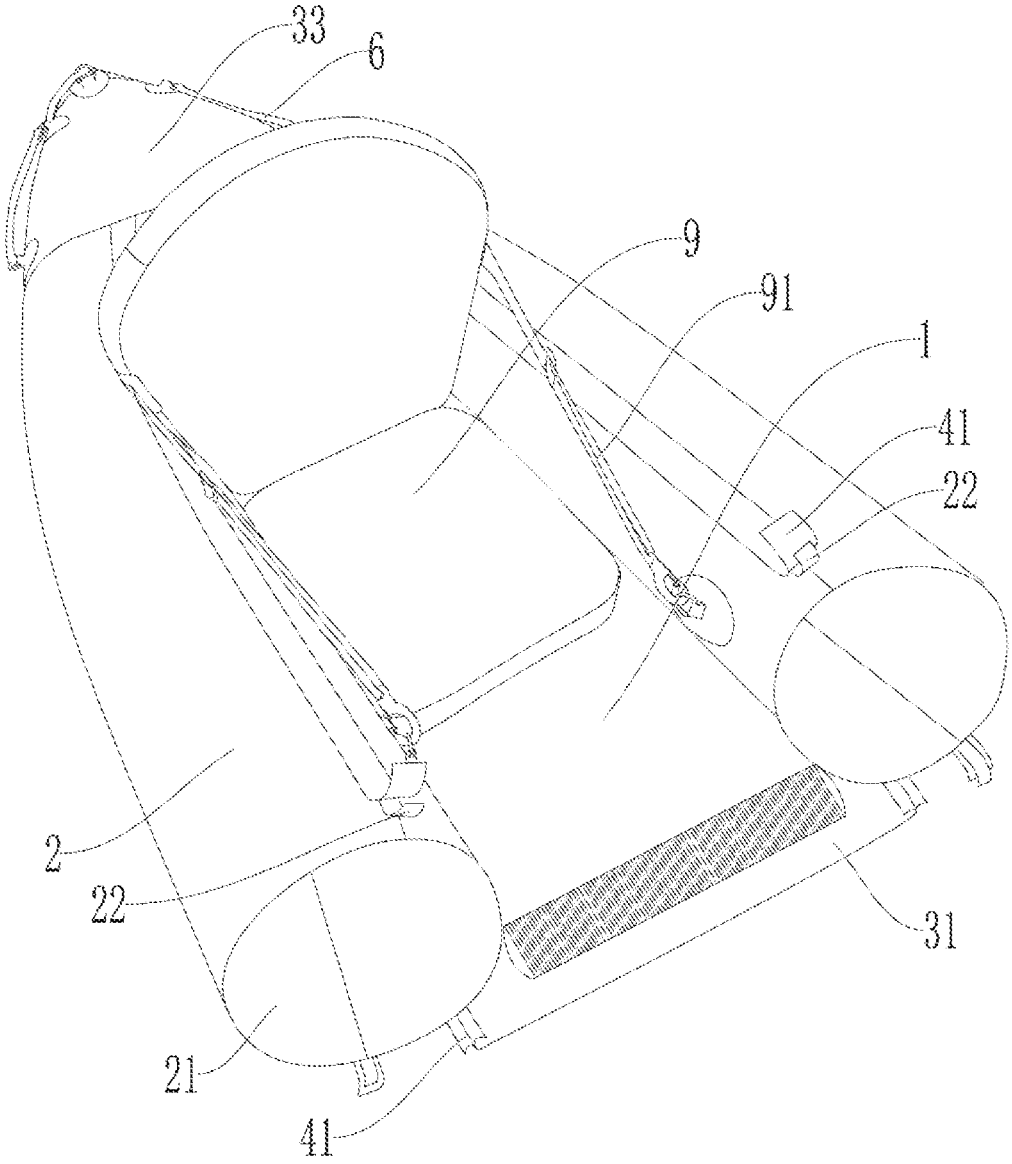
FIG. 4 is a partial structure diagram of the inflatable kayak in accordance with the first embodiment of the present disclosure.

In the drawings: 1, inflatable floor; 2, inflatable gunwale; 21, side portion; 22, edge banding strip; 23, side plate; 24, edge banding sheet;

31, bottom reinforcing layer; 32, prow hatchway cover; 33, stern hatchway cover;

41, first reinforcing strip; 42, reinforcing sheet; 43, second reinforcing strip; 44, decorative strip; 5, boat cap; 6, safety rope; 7, drain valve; 8, elastic rope; 9, seat; 91, connecting rope.

DETAILED DESCRIPTION OF THE EXEMPLARY EMBODIMENT

The technical solutions of the embodiments of the present disclosure will be clearly and completely described in the following with reference to the accompanying drawings. It is obvious that the embodiments to be described are only a part rather than all of the embodiments of the present disclosure. The components of the embodiments in the present disclosure, which are described and shown in the accompanying drawings here, may be arranged in various configurations.

Accordingly, the following detailed description of the embodiments of the present disclosure is not intended to limit the scope of the disclosure, but merely represents selected embodiments of the present disclosure. All other embodiments obtained by persons skilled in the art based on the embodiments of the present disclosure without creative efforts shall fall within the protection scope of the present disclosure.

It should be noted that similar reference numerals and letters indicate similar items in the following drawings. Therefore, once a certain item is defined in one drawing, it does not need to be further defined and explained in the subsequent drawings.

In the description of the present disclosure, it should be noted that the terms "up", "upper", "down", "left", "right", "vertical", "horizontal", "inside", "inner", "outside", "outer" etc. indicate the location or the position relationship based on the drawings, or the location or position relationship of the product of the disclosure usually placed when being used. It is only for the convenience of describing the disclosure and simplifying the description, rather than indicating or implying that the device or the element must have a specific location, be constructed and operated in a specific orientation, and therefore cannot be understood as a limitation of the present disclosure. In addition, the terms "first", "second", "third", etc. are only used for distinguishing description, and cannot be understood as indicating or implying relative importance. In the description of the present disclosure, unless specified, otherwise "a plurality of" or "multiple" means two or more than two.

In the description of the present disclosure, it should also be noted that, unless clearly specified and limited, otherwise the terms "connection" or "connect" should be understood in a broad sense, for example, it may be a fixing connection or a detachable connection, or an integral connection; it may also be a mechanical connection or an electrical connection. For those of ordinary skill in the art, the specific meanings of the above terms in the present disclosure can be understood according to specific circumstance.

In the present disclosure, unless defined and limited expressly, otherwise the relationship terms "above" or "under" between a first feature and a second feature may include that the first and second features contact with each other directly, or the first and second features contact through other features located between them. Moreover, the relationship term "above", "up", or "upper" includes that the first feature is directly above or obliquely above the second feature, or it simply means that the horizontal height of the first feature is higher than that of the second feature. The relationship term "under" or "below" includes that the first feature is directly under or obliquely under the second feature, or it simply means that the horizontal height of the first feature is less than that of the second feature.

The embodiments of the present disclosure will be described in detail below. Examples of the embodiments are shown in the accompanying drawings, in which the same or similar reference numerals indicate the same or similar elements or elements with the same or similar functions. The embodiments described below with reference to the accompanying drawings are exemplary, and are only used to explain the present disclosure, which cannot be understood as a limitation to the present disclosure.

First Embodiment

Please referring to FIGS. 1 to 4, the exemplary embodiment provides an inflatable kayak. The inflatable kayak includes an inflatable floor 1, two inflatable gunwales 2, and a reinforcing assembly.

The Inflatable floor 1 has two ends designed upward. The inflatable floor 1 is a drop stitch fabric floor made of high pressure resistant drop stitch fabric. An edge banding material is arranged at the edge of the drop stitch fabric and tightly connected to the two sides of the drop stitch fabric by sealant, to ensure the gas tightness of the inflatable floor 1. An inflation valve is defined on the upper surface of the inflatable floor 1 to facilitate inflating the inflatable floor 1 through the inflation valve.

The two ends of the inflatable floor 1 are designed upwards, so that the prow and the stern are higher than the middle of the hull, which reduces the resistance of the inflatable kayak in gliding, and makes the inflatable kayak look more attractive.

The two inflatable gunwales 2 are arranged on the left and right sides of the inflatable floor 1, and each the bottom side of the inflatable gunwales 2 is connected to one side of the inflatable floor 1 through sealant. The inflatable gunwale 2 is cylindrical, each includes two side portions 21 and two edge banding strips 22, and the two side portions 21 are butted with each other without leaving any gaps. The joints of the two side portions 21 are arranged at the upper and lower sides of the inflatable gunwale 2, and each of the joints is covered by an edge banding strip 22. The edge banding strip 22 is connected to the side portions 2 at the joint by sealant, to ensure the gas tightness of the inflatable gunwale 2.

The outer side of the edge banding strip 22 is covered with a first reinforcing strip 41 to increase the strength of the edge banding strip 22, avoiding the edge banding strip 22 being damaged caused by friction, and improving the service life of the edge banding strip 22.

The height of the upper edge at both ends of the side portion 21 is higher than the height at the middle of the side portion 21, allowing the height of the upper edge at both ends of the inflatable gunwale 2 to be higher than the height at the middle of the inflatable gunwale 2 and the height of the prow and the stern of the inflatable kayak to be no less than the height at the middle of the inflatable kayak. As such, the resistance of the inflatable kayak in gliding is reduced, and the inflatable kayak looks more attractive. An inflation valve is also provided on the inflatable gunwale 2 for inflating the inflatable gunwale 2.

The reinforcing assembly includes a bottom reinforcing layer 31. The bottom reinforcing layer 31 at least covers the joints of the inflatable floor 1 and the inflatable gunwales 2, with the bottom of the bottom reinforcing layer 31 connected to the inflatable floor 1 and the top connected to the inflatable gunwales 2 by means of adhesive or welding. Preferably, in the exemplary embodiment, the bottom reinforcing layer 31 covers the bottom surface and the lateral surface of the inflatable floor 1, and the periphery of the bottom reinforcing layer 31 is connected to the outer surface of the inflatable gunwale 2, specifically, connected to the edge banding strip 22 arranged at the bottom of the inflatable gunwale 2. The bottom reinforcing layer 31 may be attached to the bottom surface of the inflatable floor 1, or be fixed to the bottom surface of the inflatable floor 1 by bonding or welding.

The joint of the bottom reinforcing layer 31 and the inflatable gunwale 2 is covered by at least one first reinforcing strip 41. In the exemplary embodiment, the joint is overlaid with one first reinforcing strip 41, which allows the joint avoiding to be damaged caused by friction, thus improving the service life. The bottom reinforcing layer 31 covers the bottom surface and the lateral surface of the inflatable floor 1, thus in case the inflatable kayak is collided, it is the bottom reinforcing layer 31 that undergoes the impacts. Since the bottom reinforcing layer 31 has a high strength, the bottom reinforcing layer 13 is not prone to be damaged, ensuring the integrity of the inflatable kayak and increasing the service life of the inflatable kayak.

The reinforcing assembly further includes a prow hatchway cover 32 and a stern hatchway cover 33. The prow hatchway cover 32 connects the two inflatable gunwales 2 at the prow, and the stern hatchway cover 33 connects the two inflatable gunwales 2 at the stern. The prow hatchway cover 32 and the stern hatchway cover 33 are fixed to the two inflatable gunwales 2 by means of adhesive or welding.

In other embodiments, the reinforcing assembly further includes an inner reinforcing layer and an outer reinforcing layer. The outer reinforcing layer is covered on the outer side of the inflatable gunwale 2, to enhance the strength of the inflatable gunwale 2. The inner reinforcing layer is arranged on the upper surface of the inflatable floor 1 and the inner side of the inflatable gunwale 2, to enhance the strength of the inner side of the inflatable kayak.

Preferably, the inflatable kayak further includes boat caps 5 and second reinforcing strips 43. The prow and the stern are respectively sleeved with a boat cap 5, to increase the structural strength of the prow and the stern and increase the kayak's impact resistance and water breaking capacity in the water.

The second reinforcing strip 43 is arranged at the edge of the boat cap 5. The boat cap 5 at the prow is connected to the prow hatchway cover 32, the two inflatable gunwales 2, and the inflatable floor 1 through the second reinforcing strip 43. The second reinforcing strip 43 fixes the boat cap 5 to the inflatable floor 1, the inflatable gunwales 2, and the prow hatchway cover 32 or the stern hatchway cover 33.

At least one side of the prow or at least one side of the stern is provided with a safety rope 6. Preferably, in the exemplary embodiment, both sides of the prow and both sides of the stern are provided with safety ropes 6. Two ends of the safety rope 6 are fixed on the inflatable gunwale 2. Specifically, the two ends of the safety rope 6 at the prow are fixed on the prow hatchway cover 32 to be bonded or welded to the inflatable gunwale 2, the two ends of the safety rope 6 at the stern are fixed on the stern hatchway cover 33 to be bonded or welded to the inflatable gunwale 2.

The inflatable floor 1 is defined with a drain hole, and a drain valve 7 is arranged at the drain hole. Specifically, the drain valve 7 is arranged on the bottom reinforcing layer 31. Water in the kayak can be discharged through the drain hole and the drain valve 7. The quantity of the drain hole and the quantity of the drain valve 7 may be one or more, and in the exemplary embodiment is one.

Preferably, the kayak further includes an elastic rope 8. The elastic rope 8 is connected between the two inflatable gunwales 2 at the prow, and located on the side of the prow hatchway cover 32 close to the stern. Specifically, both the inflatable gunwales 2 are provided with connecting pieces which are fixed on the inflatable gunwales 2 by bonding or welding, and the elastic rope 8 is connected on the connecting pieces. The elastic rope 8 is configured to provide convenience for the boaters to place things.

A seat 9 is provided on the inflatable floor 1. Both sides of the seat 9 are provided with a connecting rope 91. The other end of the connecting rope 91 is connected to the inflatable gunwale 2.

Second Embodiment

Figure 5:
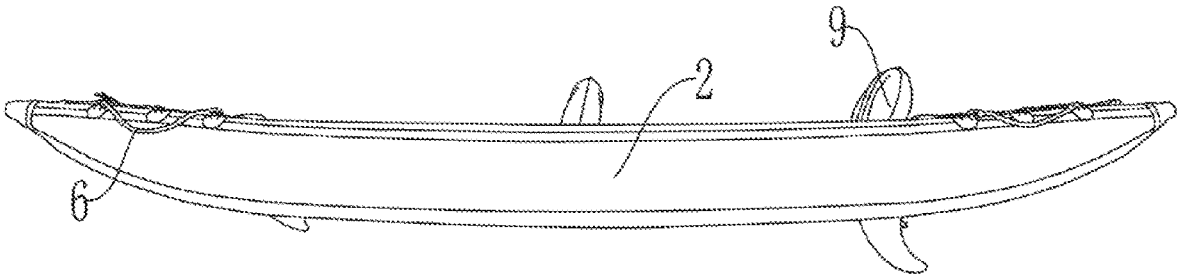
FIG. 5 is a first structure diagram of an inflatable kayak in accordance with a second embodiment of the present disclosure.
Figure 6:
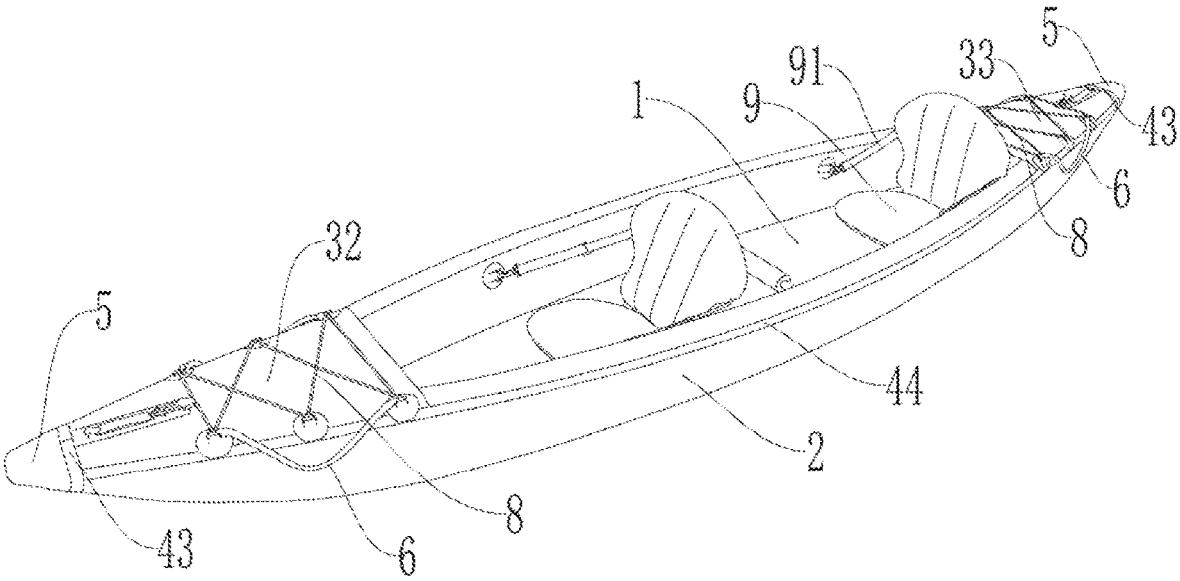
FIG. 6 is a second structure diagram of the inflatable kayak in accordance with the second embodiment of the present disclosure.
Figure 7:
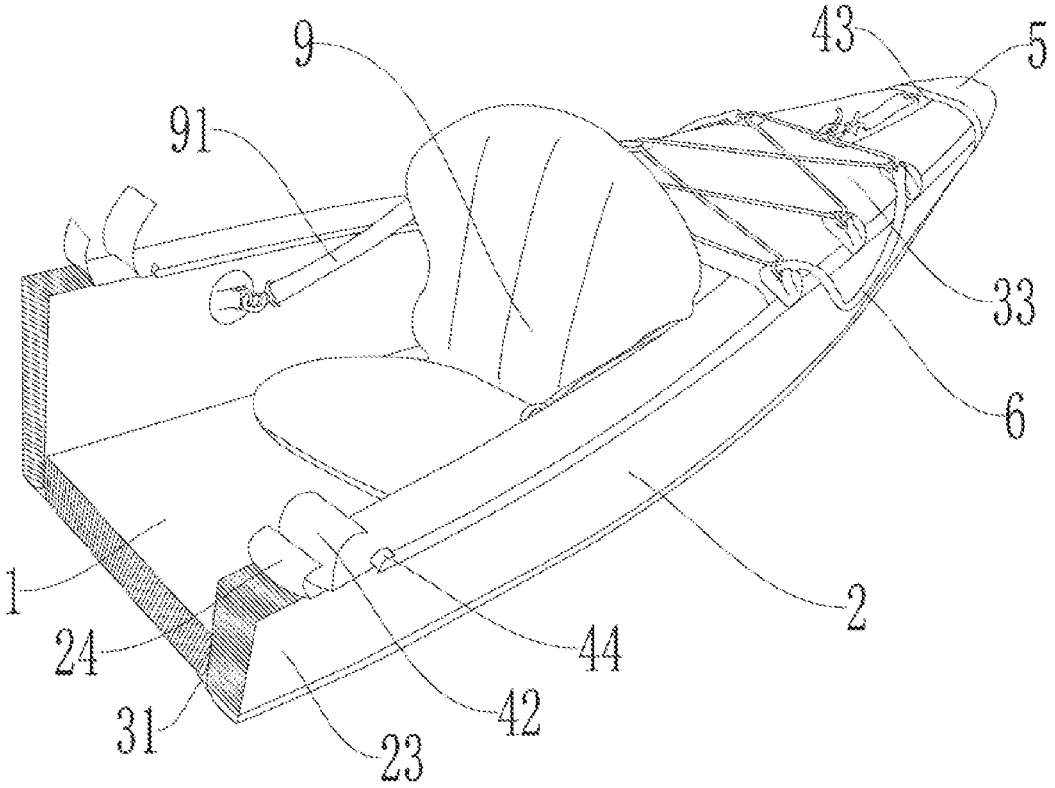
FIG. 7 is a partial structure diagram of the inflatable kayak in accordance with the second embodiment of the present disclosure.

Please referring to FIGS. 5 to 7, the exemplary embodiment provides an inflatable kayak. The inflatable kayak includes an inflatable floor 1, two inflatable gunwales 2, and a reinforcing assembly.

The Inflatable floor 1 has two ends designed upward. The inflatable floor 1 is a drop stitch fabric floor made of high pressure resistant drop stitch fabric. An edge banding material is arranged at the edge of the drop stitch fabric and tightly connected to the two sides of the drop stitch fabric by sealant, to ensure the gas tightness of the inflatable floor 1. An inflation valve is defined on the upper surface of the inflatable floor 1 to facilitate inflating the inflatable floor 1 through the inflation valve.

The two ends of the inflatable floor 1 are designed upwards, so that the prow and the stern are higher than the middle of the hull, which reduces the resistance of the inflatable kayak in gliding, and makes the inflatable kayak look more attractive.

The two inflatable gunwales 2 are arranged on the left and right sides of the inflatable floor 1, and each the bottom side of the inflatable gunwales 2 is connected to one side of the inflatable floor 1. The inflatable gunwale 2 is plate shaped, and includes a side plate 23 made of drop stitch fabric and an edge banding sheet 24 connected to a top surface of the side plate 23. The edge banding sheet 24 is covered by a reinforcing sheet 42. The reinforcing sheet 42 is fixed to the side plate 23 by bonding or welding. The reinforcing sheet 42 prevents the top of the inflatable gunwales 2 from being damaged caused by friction and impact, thus improves the service life of the inflatable gunwales 2. The height of the upper edge at both ends of the inflatable gunwales 2 is higher than the height at the middle of the inflatable gunwale 2, allowing the height of the prow and the stern of the inflatable kayak to be no less than the height at the middle of the inflatable kayak. As such, the resistance of the inflatable kayak in gliding is reduced, and the inflatable kayak looks more attractive. An inflation valve is provided on the inflatable gunwale 2 for inflating the inflatable gunwale 2.

The reinforcing assembly includes a bottom reinforcing layer 31. The bottom reinforcing layer 31 at least covers the joints of the inflatable floor 1 and the inflatable gunwales 2, with the bottom of the bottom reinforcing layer 31 connected to the inflatable floor 1 and the top connected to the inflatable gunwales 2 by means of adhesive or welding. Preferably, in the exemplary embodiment, the bottom reinforcing layer 31 covers the peripheral of the bottom surface of the inflatable floor 1, a portion of lateral surface of the inflatable floor 1, and a portion of outside surface of the inflatable gunwale 2. One side of the bottom reinforcing layer 31 is connected to the bottom surface of the inflatable floor 1 and the other side of the bottom reinforcing layer 31 is connected to the outside surface of the inflatable gunwale 2 by means of adhesive or welding. The bottom reinforcing layer 31 covers the peripheral of the bottom surface of the inflatable floor 1, a portion of lateral surface of the inflatable floor 1, and a portion of outside surface of the inflatable gunwale 2, thus in case the inflatable kayak is collided, it is the bottom reinforcing layer 31 that undergoes the impacts. Since the bottom reinforcing layer 31 has a high strength, the bottom reinforcing layer 13 is not prone to be damaged, ensuring the integrity of the inflatable kayak and increasing the service life of the inflatable kayak.

The reinforcing assembly further includes a prow hatchway cover 32 and a stern hatchway cover 33. The prow hatchway cover 32 connects the two inflatable gunwales 2 at the prow, and the stern hatchway cover 33 connects the two inflatable gunwales 2 at the stern. The prow hatchway cover 32 and the stern hatchway cover 33 are fixed to the two inflatable gunwales 2 by means of adhesive or welding.

In other embodiments, the reinforcing assembly further includes an inner reinforcing layer and an outer reinforcing layer. The outer reinforcing layer is covered on the outer side of the inflatable gunwale 2, to enhance the strength of the inflatable gunwale 2. The inner reinforcing layer is arranged on the upper surface of the inflatable floor 1 and the inner side of the inflatable gunwale 2, to enhance the strength of the inner side of the inflatable kayak.

Preferably, the inflatable kayak further includes decorative strips 44. The joint of the reinforcing sheet 42 and the side plate 23 at the outer side is covered by the decorative strip 44. The joint of the prow hatchway cover 32 and the inflatable gunwale 2 and the joint of the stern hatchway cover 33 and the inflatable gunwale 2 are both covered by the decorative strip 44. The decorative strips 44 not only make the kayak more aesthetics, but also protect the connection of the reinforcing sheet 42 and the inflatable gunwale 2.

Preferably, the inflatable kayak further includes boat caps 5 and second reinforcing strips 43. The prow and the stern are respectively sleeved with a boat cap 5, to increase the structural strength of the prow and the stern and increase the kayak's impact resistance and water breaking capacity in the water.

The second reinforcing strip 43 is arranged at the edge of the boat cap 5. The boat cap 5 at the prow is connected to the prow hatchway cover 32, the two inflatable gunwales 2, and the inflatable floor 1 through the second reinforcing strip 43. The boat cap 5 at the stern is connected to the stern hatchway cover 33, the two inflatable gunwales 2, and the inflatable floor 1 through the second reinforcing strip 43. The second reinforcing strip 43 fixes the boat cap 5 to the inflatable floor 1, the inflatable gunwales 2, and the prow hatchway cover 32 or the stern hatchway cover 33.

At least one side of the prow or at least one side of the stern is provided with a safety rope 6. Preferably, in the exemplary embodiment, both sides of the prow and both sides of the stern are provided with safety ropes 6. Two ends of the safety rope 6 are fixed on the inflatable gunwale 2. Specifically, the two ends of the safety rope 6 at the prow are fixed on the prow hatchway cover 32 to be bonded or welded to the inflatable gunwale 2, the two ends of the safety rope 6 at the stern are fixed on the stern hatchway cover 33 to be bonded or welded to the inflatable gunwale 2.

The inflatable floor 1 is defined with a drain hole, and a drain valve 7 is arranged at the drain hole. Specifically, the drain valve 7 is arranged on the bottom reinforcing layer 31 at the position of the drain hole. Water in the kayak can be discharged through the drain hole and the drain valve 7. The quantity of the drain hole and the quantity of the drain valve 7 may be one or more, and in the exemplary embodiment is one.

Preferably, the kayak further includes at least one elastic rope 8. The at least one elastic rope 8 is connected between the two inflatable gunwales 2 at the prow. Specifically, the kayak includes two elastic ropes 8, one of the elastic ropes 8 is arranged at the prow and positioned on the prow hatchway cover 32, and the other is arranged at the stern and positioned on the stern hatchway cover 33. Connecting pieces are provided at the decorative strips 44 and are fixed on the prow hatchway cover 32 or the stern hatchway cover 33 by bonding or welding, and the elastic ropes 8 are connected on the connecting pieces. The elastic rope 8 is configured to provide convenience for the boaters to place things.

A seat 9 is provided on the inflatable floor 1. Both sides of the seat 9 are provided with a connecting rope 91. The other end of the connecting rope 91 is connected to the inflatable gunwale 2.

Obviously, the foregoing embodiments of the present disclosure are merely examples for the purpose of clearly illustrating the present disclosure, and are not intended to limit the present disclosure. For those of ordinary skill in the art, changes can be made on the basis of the above description. It is unnecessary and impossible to list all the embodiments here. Any modification, equivalent replacement and improvement made within the spirit and principle of the present disclosure shall fall in the protection scope of the disclosure.

What is claimed is:

1. An inflatable kayak, comprising:

an inflatable floor (1) having two ends defined upward, the inflatable floor (1) being a drop stitch fabric floor;

two inflatable gunwales (2) arranged on the left and right sides of the inflatable floor (1), each the bottom side of the inflatable gunwales (2) being connected to one side of the inflatable floor (1), the height of the upper edge at both ends of the inflatable gunwale (2) being higher than the height at the middle of the inflatable gunwale (2), allowing the height of the prow and the stern of the inflatable kayak to be no less than the height at the middle of the inflatable kayak; and a reinforcing assembly, the reinforcing assembly comprising a bottom reinforcing layer (31), a prow hatchway cover (32), and a stern hatchway cover (33); the bottom reinforcing layer (31) at least covering the joints of the inflatable floor (1) and the two inflatable gunwales (2), the bottom of the bottom reinforcing layer (31) being connected with the inflatable floor (1), and the top of the bottom reinforcing layer (31) being connected with the inflatable gunwales (2);

the prow hatchway cover (32) connecting the two inflatable gunwales (2) at the prow, and the stern hatchway cover (33) connecting the two inflatable gunwales (2) at the stern;

wherein, the inflatable kayak further comprising boat caps (5) and second reinforcing strips (43), and the prow and the stern being respectively sleeved with a boat cap (5);

the second reinforcing strip (43) being arranged at the edge of the boat cap (5), the boat cap (5) at the prow being connected to the prow hatchway cover (32), the two inflatable gunwales (2), and the inflatable floor (1) through the second reinforcing strip (43), and the boat cap (5) at the stern being connected to the stern hatchway cover (33), the two inflatable gunwales (2), and the inflatable floor (1) through the second reinforcing strip (43).

2. The inflatable kayak according to claim 1, wherein the inflatable gunwale (2) is cylindrical, the inflatable gunwale (2) comprises two side portions (21) and two edge banding strips (22), the peripherals of the two side portions (21) are connected by the two edge banding strips (22), and the outer side of the edge banding strip (22) is covered by a first reinforcing strip (41);

the bottom reinforcing layer (31) covers the bottom surface and two lateral surfaces of the inflatable floor (1), and the lateral sides of the bottom reinforcing layer (31) connect the outer lateral sides of the inflatable gunwales (2).

3. The inflatable kayak according to claim 2, wherein the two side portions (21) are butted with each other;

the joint of the bottom reinforcing layer (31) and the inflatable gunwale (2) is covered by at least one first reinforcing strip (41).

4. The inflatable kayak according to claim 2, wherein the height of the upper edge at both ends of the side portion (21) is higher than the height at the middle of the side portion (21), allowing the height of the prow and the stern of the inflatable kayak to be no less than the height at the middle.

5. The inflatable kayak according to claim 1, wherein the inflatable gunwale (2) is plate shaped and comprises a side plate (23) made of drop stitch fabric and an edge banding sheet (24) connected to a top surface of the side plate (23), and the edge banding sheet (24) is covered by a reinforcing sheet (42);

the bottom reinforcing layer (31) covers the peripheral of the bottom surface of the inflatable floor (1), a portion of lateral surface of the inflatable floor (1), and a portion of outside surface of the inflatable gunwale (2); one side of the bottom reinforcing layer (31) is connected to the bottom surface of the inflatable floor (1) and the other side of the bottom reinforcing layer (31) is connected to the outside surface of the inflatable gunwale (2).

6. The inflatable kayak according to claim 5, further comprising decorative strips (44), the joint of the reinforcing sheet (42) and the side plate (23) at the outer side being covered by the decorative strip 44; the joint of the prow hatchway cover (32) and the inflatable gunwale (2) and the joint of the stern hatchway cover (33) and the inflatable gunwale (2) being both covered by the decorative strip (44).

7. The inflatable kayak according to claim 1, further comprising at least one elastic rope (8), and the at least one elastic rope (8) is connected between the two inflatable gunwales (2) at the prow.

8. The inflatable kayak according to claim 1, wherein at least one side of the prow or at least one side of the stern is provided with a safety rope (6), two ends of the safety rope (6) are fixed on the inflatable gunwale (2);

the safety rope (6) is fixed to the inflatable gunwale (2) by bonding or welding.

9. The inflatable kayak according to claim 1, wherein the inflatable floor (1) is defined with a drain hole, and a drain valve (7) is arranged at the drain hole; water in the kayak is discharged through the drain hole and the drain valve (7).

* * * * *